US011700942B2

(12) United States Patent
Li et al.

(10) Patent No.: US 11,700,942 B2
(45) Date of Patent: Jul. 18, 2023

(54) MECHANICALLY STRETCHABLE APPARATUS FOR A SOFA AND SOFA THEREOF

(71) Applicant: REMACRO TECHNOLOGY CO., LTD., Jiangsu (CN)

(72) Inventors: Xiaohong Li, Jiangsu (CN); Yuankun Li, Jiangsu (CN); Haibo Wang, Jiangsu (CN); Zhanzheng Lv, Jiangsu (CN)

(73) Assignee: Remacro Technology Co., Ltd., Jiangsu (CN)

( * ) Notice: Subject to any disclaimer, the term of this patent is extended or adjusted under 35 U.S.C. 154(b) by 0 days.

(21) Appl. No.: 17/516,622

(22) Filed: Nov. 1, 2021

(65) Prior Publication Data

US 2022/0047080 A1 Feb. 17, 2022

Related U.S. Application Data

(63) Continuation of application No. PCT/CN2021/081088, filed on Mar. 16, 2021.

(30) Foreign Application Priority Data

Jun. 5, 2020 (CN) ..... 202010507032.6

(51) Int. Cl.

| | |
|---|---|
| ***A47C 1/0355*** | (2013.01) |
| ***A47C 1/121*** | (2006.01) |
| ***A47C 1/032*** | (2006.01) |
| ***A47C 17/04*** | (2006.01) |

(52) U.S. Cl.

CPC ..... *A47C 1/0355* (2013.01); *A47C 17/04* (2013.01)

(58) Field of Classification Search

CPC ..... A47C 1/0355

See application file for complete search history.

(56) References Cited

U.S. PATENT DOCUMENTS

| | | | | |
|---|---|---|---|---|
| 3,394,965 | A * | 7/1968 | Peters | A47C 1/0355 297/321 |
| 10,842,274 | B1 * | 11/2020 | Crawford | A47C 1/03211 |
| 11,452,378 | B1 * | 9/2022 | Li | A47C 1/0345 |
| 11,517,109 | B2 * | 12/2022 | Browning | A47C 1/03211 |
| 2012/0049606 | A1 * | 3/2012 | Fletcher | A47C 1/0342 74/521 |
| 2015/0289655 | A1 * | 10/2015 | Lawson | A47C 1/0342 297/75 |
| 2018/0027968 | A1 * | 2/2018 | Lawson | A47C 1/0355 |
| 2018/0094711 | A1 * | 4/2018 | Lawson | F16H 25/20 |

(Continued)

*Primary Examiner* — Shin H Kim

(74) *Attorney, Agent, or Firm* — Arch & Lake LLP

(57) ABSTRACT

A mechanically stretchable apparatus for a sofa and a sofa thereof are provided. The mechanically stretchable apparatus includes: a seat component, a linkage component, a back component and a leg component. The seat component further includes a base, a first rotating part, the second rotating part, and the seat linkage structure placed between the first and second rotating parts. The seat linkage structure includes a back linkage with a seat connection point, a transmission connection point, and a back connection point. The seat connection point is connected to the first rotating part. The back connection point is connected to the back component. The back component and the leg component are respectively connected to the linkage component, and the linkage component is connected to the seat linkage structure.

16 Claims, 3 Drawing Sheets

(56) References Cited

U.S. PATENT DOCUMENTS

| | | | | |
|---|---|---|---|---|
| 2018/0242740 | A1* | 8/2018 | Lawson | A47C 1/024 |
| 2020/0367652 | A1* | 11/2020 | Crawford | A47C 1/0355 |
| 2021/0219725 | A1* | 7/2021 | Sun | A47C 1/03211 |
| 2021/0219727 | A1* | 7/2021 | Zhang | A47C 3/20 |
| 2021/0353064 | A1* | 11/2021 | Chen | A47C 1/0355 |
| 2021/0361070 | A1* | 11/2021 | Zhang | A47C 1/0355 |
| 2022/0039558 | A1* | 2/2022 | Zhang | A47C 1/035 |
| 2022/0378206 | A1* | 12/2022 | Sun | A47C 1/0355 |

* cited by examiner

MECHANICALLY STRETCHABLE APPARATUS FOR A SOFA AND SOFA THEREOF

CROSS-REFERENCE TO RELATED APPLICATION

The present application is based on and claims the priority to the PCT International Application No. PCT/CN2021/081088, filed on Mar. 16, 2021 which claims priority to Chinese patent application No. 202010507032.6 filed on Jun. 5, 2020, the entire content of which is hereby incorporated by reference for all purposes.

TECHNICAL FIELD

The disclosure relates to the field of a mechanical apparatus for seating units, specifically, a mechanically stretchable apparatus for a sofa and a sofa thereof.

BACKGROUND

Nowadays, with the improvement of productivity and the development of economy in the society, people's standard of living has improved, and people's requirements for furniture are also getting more specific. Sofas and rocking chairs have become common pieces of furniture. Some sofas have extendable footrests, and some other sofas can raise and lower their backrest.

SUMMARY

The present disclosure provides a mechanically stretchable apparatus for a sofa, and a sofa thereof.

The first aspect of the present disclosure provides a stretchable apparatus for a sofa. The apparatus includes a seat component, a linkage component, a back component, and a leg component. The seat component further includes: a base, a first rotating part, a second rotating part, and a seat linkage structure. The first rotating member and the second rotating member are both connected to the base, and the seat linkage structure is disposed between the first rotating part and the second rotating part. The linkage component is connected to the seat linkage structure. The seat linkage structure further includes a back linkage with a seat connection point, a transmission connection point, and a back connection point. The seat connection point is connected to the first rotating part. The distance between the transmission connection point and the seat connection point is L1, the distance between the transmission connection point and the back connection point is L2, and a ratio between L1 and L2 is between 0.75-0.95. The back component is connected to the back connection point and the linkage component, and the leg component is connected to the linkage component.

In the second aspect of the present disclosure, a stretchable sofa is provided, and the stretchable sofa includes: a seat; a backrest disposed on a back side of the seat; a footrest disposed on a front side of the seat; and a mechanically stretchable apparatus as described in the first aspect of the present disclosure It is to be understood that both the foregoing general description and the following detailed description are exemplary and explanatory only and are not restrictive of the present disclosure.

BRIEF DESCRIPTION OF THE DRAWINGS

The drawings described here are used to provide a further understanding of the present disclosure and constitute a part of the present disclosure. The examples and descriptions of the present disclosure are used to explain the present disclosure, and do not constitute an improper limitation of the present disclosure.

DETAILED DESCRIPTION

Figure 1:
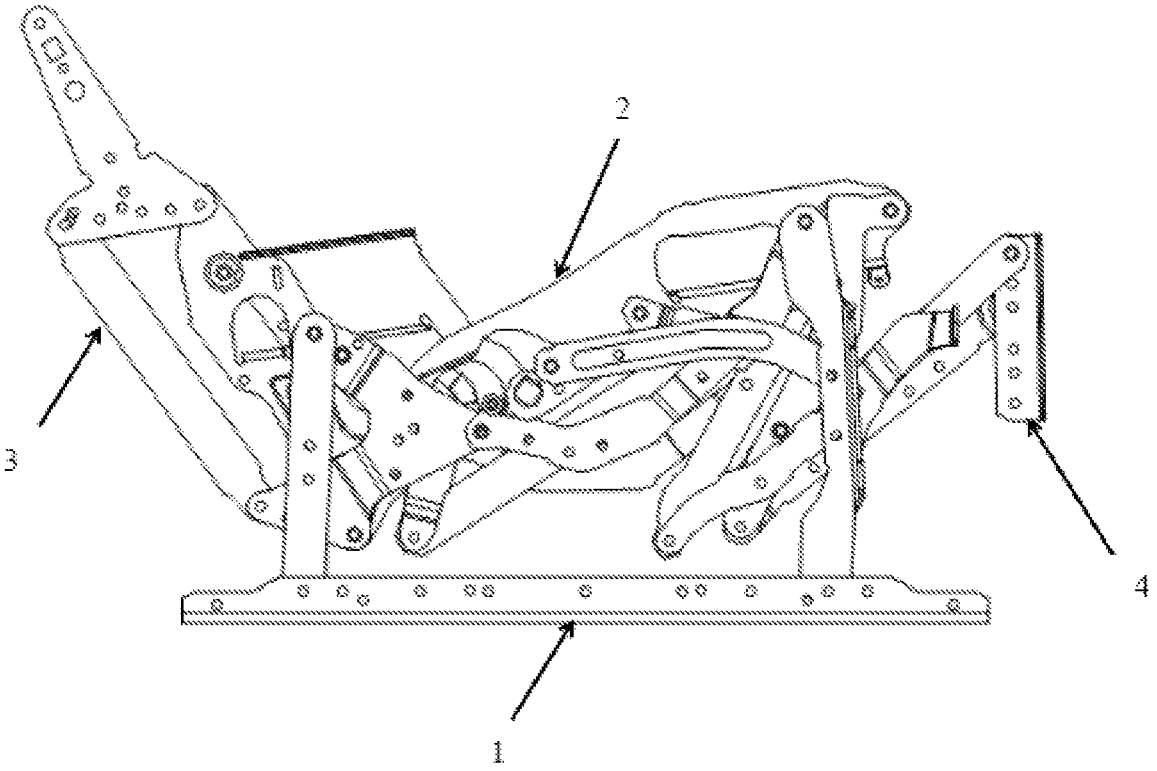
FIG. 1 illustrates a side view of a mechanically stretchable apparatus of a sofa according to one or more examples of the present disclosure.

The present disclosure is described with reference to examples and corresponding drawings. The described examples are only part but not all of the examples of the present disclosure. Based on the examples in the present disclosure, all other examples obtained by those ordinary skilled in the art without any inventive work belong to the protection scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The description of numerals used in this disclosure may include: 1—the seat component, 2—the linkage component, 3—the back component, 4—the leg component, 5—the support component, 11—base, 12—first rotating part, 13—second rotating part, 14—seat linkage structure, 1411—seat connection point, 1412—transmission connection point, 1413—back connection point, 1414—linkage connection point, 21—side linkage, 22—fixed connecting piece, 23—leg drive component, 24—leg transmission component, 25—first connector, 26—second connector, 31—back support, 32—back linkage, 41—pedal, 42—first leg linkage, 43—second leg linkage, 51—first supporter, and 52—second supporter.

The chair unit usually has a base, a backrest, a footrest, a seat, and a reclining apparatus. The chair unit can be converted among different positions, such as a sitting position, and a lying position. In the sitting position, the backrest of the chair is generally vertically and upright disposed, and the seat is generally horizontally disposed. In the lying position, the backrest of the chair is fully reclined in a stretch state, and the footrest remains generally horizontally in front of the seat in the stretch state. Conversion among above-mentioned positions of chair unit may be performed by the operation of the user manually, or performed automatically by an electric manner.

However, some sofas with extendable parts have the following shortcomings: the extendable parts of these sofas on the market do not make users feel comfortable when they move; users cannot experience weightlessness when they lie down on the sofa and with their legs and head moving at the same time with the extendable parts; and the structural stability of these sofas is poor.

The present disclosure provides a mechanically stretchable apparatus for a sofa, and a sofa thereof.

Example 1

Figure 2:
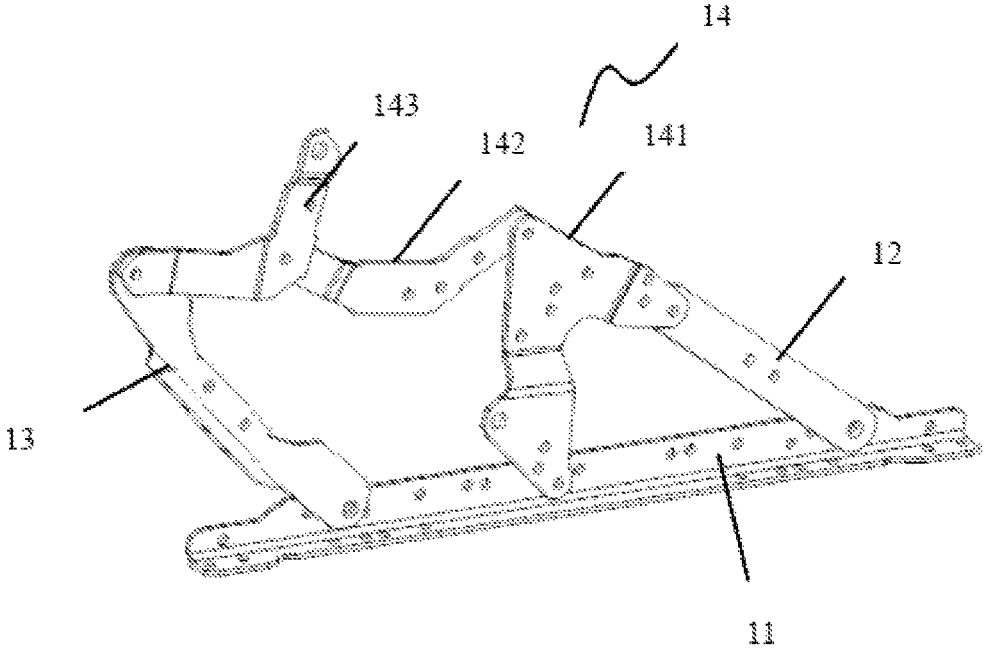
FIG. 2 illustrates a perspective view of the seat component according to one or more examples of the present disclosure.
Figure 3:
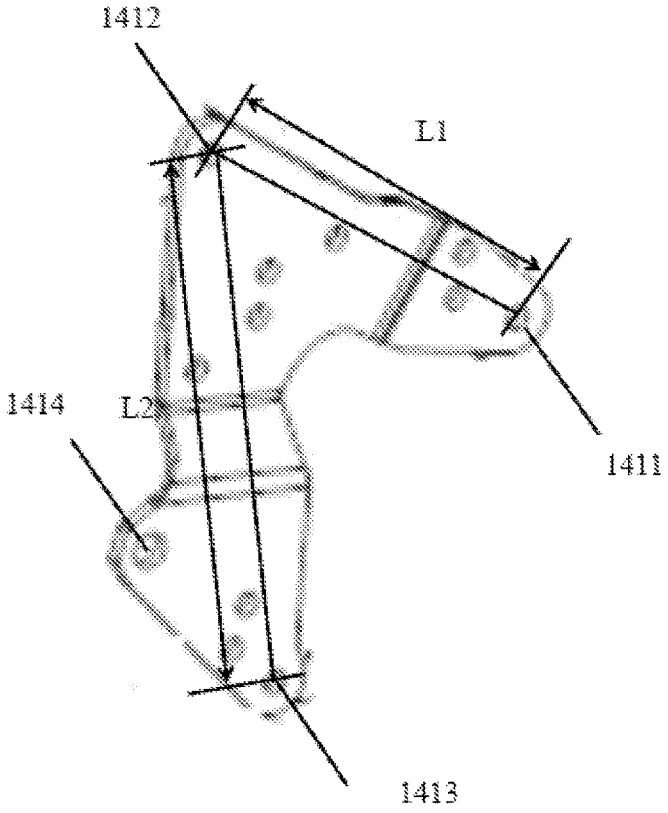
FIG. 3 illustrates a perspective view of the back linkage according to one or more examples of the present disclosure.
Figure 4:
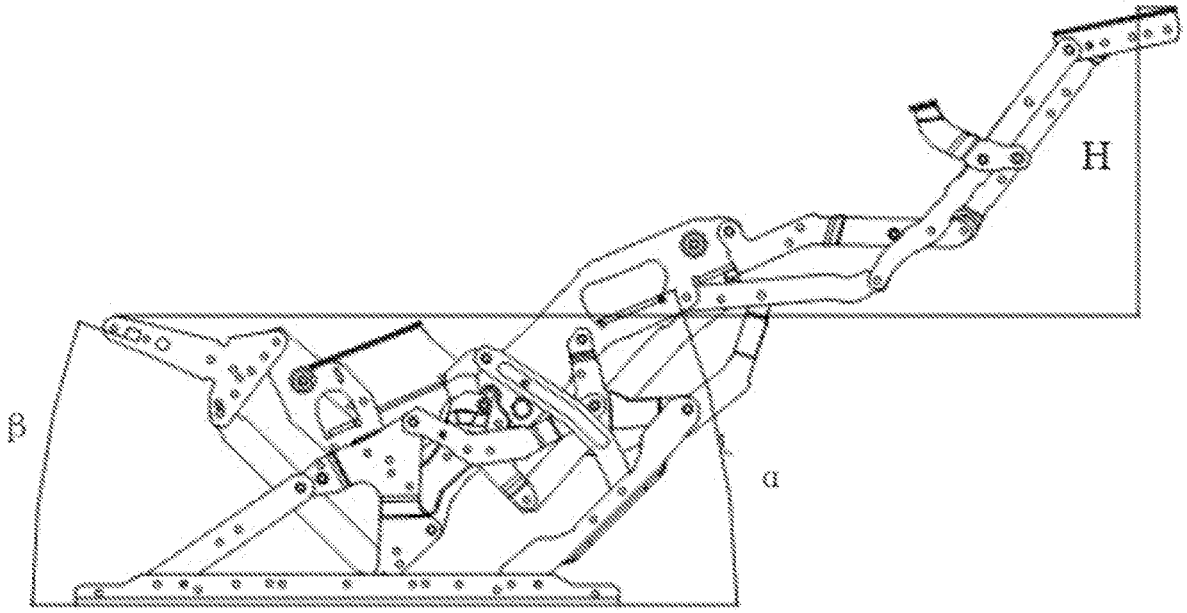
FIG. 4 illustrates a side view of the mechanically stretchable apparatus in the stretch state according to one or more examples of the present disclosure.
Figure 5:
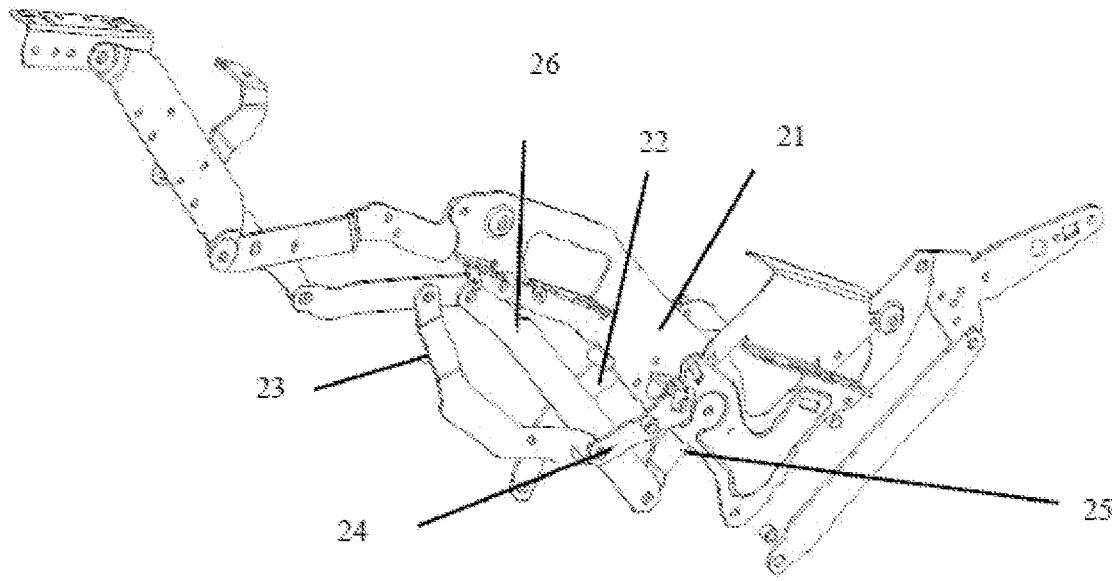
FIG. 5 illustrates a perspective view of the linkage component according to one or more examples of the present disclosure.
Figure 6:
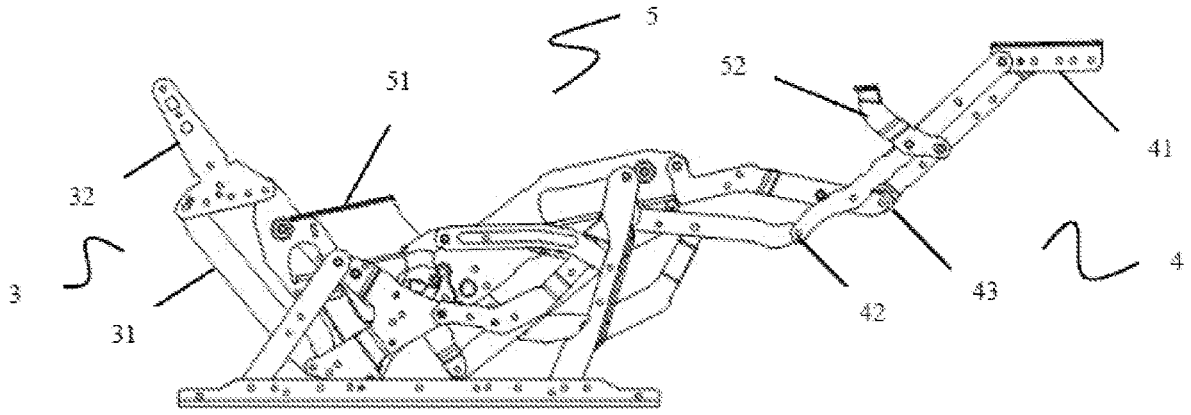
FIG. 6 illustrates another side view of the mechanically stretchable apparatus in the stretch state according to one or more examples of the present disclosure.

Example 1 provides a mechanically stretchable apparatus for a sofa, as shown in FIGS. 1-6. The mechanically stretchable apparatus includes: a seat component 1, a linkage component 2, a back component 3 and a leg component 4.

The seat component 1 includes: a base 11, a first rotating part 12, a second rotating part 13, and a seat linkage structure 14, wherein the first rotating part 12 and the second rotating part 13 are both connected with the base 11, and the seat linkage structure 14 is placed between the first rotating part 12 and the second rotating part 13.

The seat linkage structure 14 includes: a back linkage 141 with a seat connection point 1411, a transmission connection point 1412, and a back connection point 1413. The seat connection point 1411 is connected to the first rotating part 12. The back connection point 1413 is connected to the back component 3. Wherein, if the distance between the transmission connection point 1412 and the seat connection point 1411 is L1, and the distance between the transmission connection point 1412 and the back connection point 1413 is L2, the ratio between L1 and L2 is 0.75-0.95.

The back component 3 and the leg component 4 are respectively connected to the linkage component 2. The linkage component 2 is connected to the seat linkage structure 14.

In one example of the present disclosure, the ratio between L1 and L2 is 0.95.

Specifically, both the back component 3 and the leg component 4 can be adjusted to a stretch state with respect to the seat component 1, wherein the back component and the leg component are adjusted simultaneously, so that the back component and the leg component can move simultaneously, and therefore, the user's comfort level can be enhanced.

Further, when the back component 3 and the leg component 4 are adjusted to a stretch state, the highest point of the leg component is higher than the highest point of the back component. Wherein, if the difference between the highest point of the leg component 4 and the highest point of the back component 3 is H, $H \leq 300$ mm.

In an example, if the difference between the highest point of the leg component 4 and the highest point of the back component 3 is H, H is 260 mm.

Further, while the back component 3 and the leg component 4 are adjusting to the stretch state, 40 mm$\leq H \leq$260 mm.

Specifically, the base 11 is placed on the ground and should be kept horizontal.

Further, if the angle between the linkage component 2 and the base 11 is $\alpha$, and correspondingly, the angle between the back component 3 and the base 11 is $\beta$, when the back component 3 and the leg component 4 are adjusted to the stretch state, $\alpha=20°$ and $\beta=20°$.

Further, during the process of the back component 3 and the leg component 4 being adjusted to the stretch state, $\alpha \leq 20°$ and $\beta \geq 20°$. The limitations upon these above-mentioned distances and angles can enhance a user's comfort level while the apparatus is adjusted to the stretch state.

Specifically, the seat linkage structure 14 further includes a seat transmission linkage 142 and a seat linkage 143. Wherein one end of the seat transmission linkage 142 is connected to the transmission connection point 1412, and the other end of the seat transmission linkage is connected to one end of the seat linkage 143. The other two ends of the seat linkage 143 are respectively connected to the second rotating part 13 and the linkage component 2.

Further, the back linkage 141 also includes a linkage connection point 1414, which is connected to the linkage component 2.

Further, if the linkage connection point 1414 is connected to the linkage component 2 at point A, and the seat linkage 143 is connected to the linkage component at point B, point A and point B do not overlap.

Specifically, the linkage component 2 includes a side linkage 21 and a fixed connecting piece 22. One end of the side linkage 21 is connected to the back component 3, and the other end of the side linkage 21 is connected to the leg component 4. One end of the fixed connecting piece 22 is connected to the side linkage 21, and the other end of the fixed connecting piece is connected to the second rotating piece 13. Wherein the fixed connecting piece 22 is in the shape of an arc, so that the stability of the leg component and the back component's simultaneous movements can be enhanced.

Further, the linkage component 2 includes: the leg drive component 23, the leg transmission component 24, the first connector 25, and the second connector 26. One end of the first connector 25 is connected to the side linkage 21, and the other end of the first connector 25 is connected to one end of the second connector 26. The other end of the second connector 26 is connected to the leg component 4.

The leg drive component 23 is connected to the leg component 4 via the leg transmission component 24. In this way, the transmission of the structure can be enhanced, and avoid getting stuck. The leg transmission component 24 is driven by a single motor or manually.

Specifically, the back component 3 includes a back support 31 and a back linkage 32. One end of the back support 31 is connected to the back linkage 32, and the other end of the back support 31 is connected to the side linkage 21, wherein the back linkage 32 is connected to the back connection point 1413.

Specifically, the leg component 4 includes a pedal 41, the first leg linkage 42, and the second leg linkage 43. Both the first leg linkage 42 and the second leg linkage 43 are connected to the pedal 41. The first leg linkage 42 is connected to the second connector 26, and the second leg linkage 43 is connected to the side linkage 21.

In some examples, the mechanically stretchable apparatus for a sofa includes support component 5. The support component 5 includes a first supporter 51 and a second supporter 52. The first supporter 51 is located upon the back component 3, and the second supporter 52 is located upon the leg component 4.

In such example, the back and leg components can move simultaneously in a steady manner, enabling users to experience weightlessness while lying on the sofa.

Example 2

Example 2 provides a mechanically stretchable apparatus of a sofa. One difference between Example 2 and Example 1 is: the ratio between L1 and L2 is 0.75.

Further, the difference between the highest point of the leg component 4 and the highest point of the back component 3 (H) is 300 mm.

Further, during the process of the back component 3 and the leg component 4 being adjusted to the stretch state, 40 mm≤H≤300 mm.

Further, if the angle between the linkage component 2 and the base 11 is α, and correspondingly, the angle between the back component 3 and the base 11 is β, when the back component 3 and the leg component 4 are adjusted to the stretch state, α=22° and β=19°.

Further, during the process of the back component 3 and the leg component 4 being adjusted to the stretch state, α≤22° and β≥19°. The limitations upon these above-mentioned distances and angles can enhance a user's comfort level while the apparatus is adjusted to the stretch state.

The other components or structures in Example 2 are the same as in Example 1.

In such example, the height difference between the highest point of the leg component and the highest point of the back component may be maximized, enabling a user to experience a greater sense of weightlessness.

Example 3

Example 3 provides a mechanically stretchable apparatus of a sofa. One difference between Example 3 and Example 1 is: the ratio between L1 and L2 is 0.6.

Further, the difference between the highest point of the leg component 4 and the highest point of the back component 3 (H) is 280 mm.

Further, during the process of the back component 3 and the leg component 4 being adjusted to the stretch state, 40 mm≤H≤280 mm.

Further, if the angle between the linkage component 2 and the base 11 is α, and correspondingly, the angle between the back component 3 and the base 11 is β, when the back component and the leg component 4 are adjusted to the stretch state, α=21° and β=19.5°.

Furthermore, during the process of the back component 3 and the leg component 4 being adjusted to the stretch state, α≤21° and β≥19.5°. The limitations upon these above-mentioned distances and angles can enhance a user's comfort level while the apparatus is adjusted to the stretch state.

The other components or structures in Example 3 are the same as in Example 1.

Such example balances the stability of the structure when the back component and the leg component simultaneously move and the user's experience of weightlessness when lying down.

Because the connection points in the back linkage are spaced unevenly, when the back component and the leg component are adjusted to the stretch state, the height difference between the highest point of the lower part and the highest point of the back part in the mechanically stretchable apparatus for a sofa as disclosed in Examples 1-3 is larger than in other mechanically stretchable apparatus for sofas. When the apparatus is at its stretch state and a user is lying on the sofa, the user's legs are higher than the head, which enables a user to experience complete weightlessness. The presently disclosed mechanically stretchable apparatus for a sofa has a stable structure, as well as an ingenious design that has wide applicability and is easy to promote.

In addition, the present disclosure also relates to an extendable sofa unit. The sofa unit comprises: a base for supporting on the ground, a seat part located above the base, a backrest located behind the seat part, a footrest located in front of the seat part or below the seat part, and the aforementioned mechanically stretchable apparatus. The extendable chair unit may be an extendable swing chair, an extendable rocking chair, a sofa with a swing, gliding or rocking function, and the like.

The present disclosure provides a mechanically stretchable apparatus for a sofa, which includes: a seat component, a linkage component, a back component, and a leg component. The seat assembly includes a base, a first rotating part, a second rotating part, and a seat linkage structure.

Both the first rotating part and the second rotating part are connected to the base, and the seat linkage structure is placed between the first rotating part and the second rotating part. The seat linkage structure includes a back linkage. The back linkage has a seat connection point and a transmission connection point and a back connection point. The seat connection point is connected to the first rotating part. The back connection point is connected to the back component. If the distance between the transmission connection point and the seat connection point is L1, and the distance between the transmission connection point and the back connection point is L2, the ratio of L1 and L2 is in the 0.75-0.95 range. The back component and the leg component are both connected to the linkage component. The linkage component is connected to the seat linkage structure.

Further, both the back component and the leg component can be adjusted to a stretch state with respect to the seat component, wherein the back component and the leg component are adjusted simultaneously.

Further, when the back component and the leg component are both adjusted to a stretch state, the height of the highest point of the leg assembly is greater than the height of the highest point of the back assembly, wherein if the difference between the highest point of the leg component and the highest point of the back component is H, H≤300 mm.

Further, during the process of the back component and the leg component both being adjusted to the stretch state, 40≤mm H≤300 mm.

Further, if the angle between the linkage component and the base is α, and the angle between the back component and the base is β, when the back component and the leg component are adjusted to the stretch state, α=22° and β=19°.

Further, during the process of the back component and the leg component being adjusted to the extended state, α≤22°, and β≥19°.

Further, the base is set on the ground.

Further, the seat linkage structure further includes: a seat transmission linkage and a seat linkage, wherein one end of the seat transmission linkage is connected to the transmission connection point, one end of the seat linkage is connected to the seat transmission linkage, and the remaining two ends of the seat linkage are respectively connected to the second rotating part and the linkage component.

Further, the back linkage member further includes a linkage connection point, and the linkage connection point is connected to the linkage component.

Further, the linkage component includes a side linkage member and a fixed connecting piece, wherein one end of the side linkage member is connected to the back assembly, the other end of the side linkage member is connected to the leg assembly, and one end of the fixed connecting piece is connected to the side linkage piece, and the other end of the fixed connecting piece is connected to the second rotating part.

Due to the above technical solutions, the present invention has the following beneficial effects:

1) Because the connection points in the back linkage are spaced unevenly, when the back component and the leg component are adjusted to the stretch state, the height difference between the highest point of the lower part and the highest point of the back part in the presently disclosed mechanically stretchable apparatus for a sofa is larger than in other mechanically stretchable apparatus for sofas. When the apparatus is at its stretch state and a user is lying on the apparatus, the user's legs are higher than the head, which enables a user to experience complete weightlessness. The presently disclosed mechanically stretchable apparatus for a sofa has a stable structure, as well as an ingenious design that has wide applicability and is easy to promote.

2) The mechanically stretchable apparatus for a sofa of the present disclosure, through the seat linkage structure, can enable the leg component and the back component to move at the same time, and thus enhancing a user's comfort level during the process of the apparatus being adjusted to the stretch state.

3) The fixed connecting piece in the linkage component can stabilize the structure of the presently disclosed mechanically stretchable apparatus when the leg component and the back component move simultaneously.

The present disclosure may include dedicated hardware implementations such as application specific integrated circuits and other hardware devices. The hardware implementations can be constructed to implement one or more of the methods described herein. Examples that may include the apparatus and systems of various implementations can broadly include a variety of mechanical systems. One or more examples described herein may implement functions using two or more specific interconnected hardware devices or units with related control and data signals that can be communicated between and through the units, or as portions of the device. Accordingly, the apparatus or system disclosed may encompass software and hardware implementations. The terms "circuit," "sub-circuit," "unit," or "sub-unit" may include memory (shared, dedicated, or group) that stores code or instructions that can be executed. The unit or circuit may include one or more components that are connected.

The above examples of the present disclosure focus on the differences among various examples, and the different optimization features among the various examples can be combined to form a better example as long as they are not contradictory, which will not be detailed here for brevity concern.

The above-described are only examples of the present disclosure, and are not used to limit the present disclosure. For those skilled in the art, various modifications and variations are possible. Any modification, equivalent substitution, improvement, and others made within the spirit and principle of the present disclosure shall be included within the scope the present disclosure.

What is claimed is:

1. A mechanically stretchable apparatus for a sofa, comprising:

a seat component, wherein the seat component further comprises: a base, a first rotating part, a second rotating part, and a seat linkage structure, wherein the first rotating member and the second rotating member are both connected to the base, and the seat linkage structure is disposed between the first rotating part and the second rotating part;

a linkage component that is connected to the seat linkage structure, wherein the seat linkage structure further comprises a back linkage with a seat connection point, a transmission connection point, and a back connection point, wherein the seat connection point is connected to the first rotating part, and wherein a distance between the transmission connection point and the seat connection point is L1, a distance between the transmission connection point and the back connection point is L2, and a ratio between L1 and L2 is between 0.75-0.95, the back linkage further comprises a linkage connection point that is connected to the linkage component, the linkage component further comprises a side linkage with two ends and a fixed connecting piece with two ends, wherein a first end of the side linkage is connected to the back component, and a second end of the side linkage is connected to the leg component, and an end of the fixed connecting piece is connected to the second rotating part;

a back component that is connected to the back connection point and the linkage component; and a leg component that is connected to the linkage component.

2. The mechanically stretchable apparatus of claim 1, wherein the back component and the leg component are adjusted to a stretch state at a same time.

3. The mechanically stretchable apparatus of claim 2, wherein in response to that the back component and the leg component are adjusted to the stretch state, a highest point of the leg component is higher than a highest point of the back component, wherein a difference between the highest point of the leg component and the highest point of the back component is H, and H is less than or equal to 300 mm.

4. The mechanically stretchable apparatus of claim 3, wherein during a process of the back component and the leg component being adjusted to the stretch state, 40 mm≤H≤300 mm.

5. The mechanically stretchable apparatus of claim 2, wherein an angle between the linkage component and the base is $\alpha$, an angle between the back component and the base is $\beta$, when the back component and the leg component are both adjusted to the stretch state, $\alpha=22°$ and $\beta=19°$.

6. The mechanically stretchable apparatus of claim 5, wherein during a process of the back component and the leg component being adjusted to the stretch state, $\alpha\leq22°$ and $\beta\leq19°$.

7. The mechanically stretchable apparatus of claim 6, wherein the base is set on ground.

8. The mechanically stretchable apparatus of claim 1, wherein the seat linkage structure further comprises a seat transmission linkage with two ends and a seat linkage with three ends, wherein:

a first end of the seat transmission linkage is connected to the transmission connection point, and a second end of the seat transmission linkage is connected to a first end of the seat linkage; and remaining two ends of the seat linkage are respectively connected to the second rotating part and the linkage component.

9. A stretchable sofa, comprising:

a seat;

a backrest disposed on a back side of the seat;

a footrest disposed on a front side of the seat; and a mechanically stretchable apparatus, comprising:

a seat component, wherein the seat component further comprises: a base, a first rotating part, a second rotating part, and a seat linkage structure, wherein the first rotating member and the second rotating member are both connected to the base, and the seat linkage structure is disposed between the first rotating part and the second rotating part;

a linkage component that is connected to the seat linkage structure, wherein the seat linkage structure further comprises a back linkage with a seat connection point, a transmission connection point, and a back connection point, wherein the seat connection point is connected to the first rotating part, and wherein a distance between the transmission connection point and the seat connection point is L1, a distance between the transmission connection point and the back connection point is L2, and a ratio between L1 and L2 is between 0.75-0.95, the back linkage further comprises a linkage connection point that is connected to the linkage component, the linkage component further comprises a side linkage with two ends and a fixed connecting piece with two ends, wherein a first end of the side linkage is connected to the back component, and a second end of the side linkage is connected to the leg component, and an end of the fixed connecting piece is connected to the second rotating part;

a back component that is connected to the back connection point and the linkage component; and a leg component that is connected to the linkage component.

10. The stretchable sofa of claim 9, wherein the back component and the leg component are adjusted to a stretch state at a same time.

11. The stretchable sofa of claim 10, wherein in response to that the back component and the leg component are adjusted to the stretch state, a highest point of the leg component is higher than a highest point of the back component, wherein a difference between the highest point of the leg component and the highest point of the back component is H, and H is less than or equal to 300 mm.

12. The stretchable sofa of claim 11, wherein during a process of the back component and the leg component being adjusted to the stretch state, 40 mm≤H≤300 mm.

13. The stretchable sofa of claim 10, wherein an angle between the linkage component and the base is $\alpha$, an angle between the back component and the base is $\beta$, when the back component and the leg component are both adjusted to the stretch state, $\alpha=22°$ and $\beta=19°$.

14. The stretchable sofa of claim 13, wherein during a process of the back component and the leg component being adjusted to the stretch state, $\alpha\leq22°$ and $\beta\geq19°$.

15. The stretchable sofa of claim 14, wherein the base is set on ground.

16. The stretchable sofa of claim 9, wherein the seat linkage structure further comprises a seat transmission linkage with two ends and a seat linkage with three ends, wherein:

a first end of the seat transmission linkage is connected to the transmission connection point, and a second end of the seat transmission linkage is connected to a first end of the seat linkage; and remaining two ends of the seat linkage are respectively connected to the second rotating part and the linkage component.

* * * * *